United States Patent [19]

Semcer

[11] Patent Number: 4,728,069

[45] Date of Patent: Mar. 1, 1988

[54] ARTICLE ATTACHMENT FOR BARS, TABLES AND THE LIKE

[76] Inventor: John P. Semcer, 1 Prospect St., South Orange, N.J. 07079

[21] Appl. No.: 942,256

[22] Filed: Dec. 16, 1986

[51] Int. Cl.[4] ..... A47B 96/06

[52] U.S. Cl. ..... 248/231.7; 248/301; 248/314

[58] Field of Search ..... 248/214, 215, 227, 228, 248/231.5, 231.6, 231.7, 301, 309.1, 314; 24/343

[56] References Cited

U.S. PATENT DOCUMENTS

| | | | |
|---|---|---|---|
| 218,579 | 8/1879 | Robison | 248/231.7 |
| 680,680 | 8/1901 | Armstrong | 248/231.7 |
| 1,220,717 | 3/1917 | Bennett | 248/227 |
| 1,527,042 | 2/1925 | Gaut | 248/231.7 |
| 1,629,204 | 5/1927 | Cote | 248/227 |
| 1,801,637 | 4/1931 | Nichols | 248/231.7 |
| 2,243,933 | 7/1947 | Gosh | 248/231.7 |
| 2,461,071 | 2/1949 | Mettenleiter | 248/227 |
| 2,709,563 | 5/1955 | Starkey | 248/231.7 |
| 2,930,567 | 3/1960 | Lloyd-Young | 248/309.1 |
| 3,300,168 | 1/1967 | Gaudino | 248/227 |
| 3,376,006 | 4/1968 | Zezula | 248/227 |
| 3,934,804 | 1/1976 | Bruce | 248/231.7 |
| 4,066,232 | 1/1978 | Hermeyer | 248/231.5 |

FOREIGN PATENT DOCUMENTS

| | | | |
|---|---|---|---|
| 471831 | 1/1929 | Fed. Rep. of Germany | 248/227 |
| 653160 | 11/1928 | France | 248/231.7 |
| 403559 | 6/1966 | Switzerland | 248/231.7 |

*Primary Examiner*—J. Franklin Foss
*Assistant Examiner*—Robert A. Olson
*Attorney, Agent, or Firm*—Daniel H. Bobis

[57] ABSTRACT

A removeably mountable article attachment device for bars, tables or the like has a clamping assembly with an upper section, a lower section, an intermediate section, and means for manually securing the same to said bar or table, at least one receptacle fixedly connected to said upper section for holding various articles therein, sized slot means disposed in said upper section for holding various items therein, said receptacles and slot means being located so that the articles held therein are easily accessible to all gathered about the table or bar, and hook means depending from said lower section for hanging handbags, towels and the like so that the same are hidden from guests yet are easily accessible to the host or bartender.

10 Claims, 6 Drawing Figures

ARTICLE ATTACHMENT FOR BARS, TABLES AND THE LIKE

BACKGROUND OF THE INVENTION

The invention described herein relates generally to attachments which can be removably mounted on a piece of furniture or the like in order to hold various articles such as a deck of playing card, a package of cigarettes, a book of matches, a beverage tumbler, and an ashtray. More particularly, the present invention relates to attachments as above described which can be removably mounted to the side edge of a bar, table, or similar pieces of furniture.

Attachment devices of this nature are well known in the art as is shown in U.S. Pat. Nos. 1,527,042 and 1,801,637. These patents both disclose attachment devices which provide receptacles for holding various articles or to serve as ashtrays. However, these patents further indicate that the prior art is deficient with respect to providing means for hanging handbags, or the like. Equally important, it is apparent that the prior art attachment devices fail to situate receptacles or other article holding means at locations which would be accessible from across the table or bar, thus requiring a number of attachment devices be mounted about a table. The prior art receptacles are located away from the edge of the table or bar and, oftentimes, below the horizontal plane thereof.

Although the prior art attachment devices have provided a modicum of convenience for those gathered around a bar or table, such convenience was severely limited by the above shortcomings, thus making it clear that improvements with respect to accessibility and further article holding means are warranted.

The present invention provides an attachment assembly for holding various articles which is inexpensive to manufacture and readily mountable to the horizontal side edge of a piece of furniture in such a manner that the articles held thereby are easily accessible from the remote side of the table or bar. The attachment assembly in accordance with the present invention further contemplates the desirability of having handbags in close proximity to the table or bar, and thus provides means for holding the same, the structure of which will be described below.

SUMMARY OF THE INVENTION

Thus, the present invention covers an article attachment assembly or device for holding articles in easily accessible locations on bars, tables or the like and includes, a clamping assembly, means associated with said clamping assembly for removably mounting the same into assembled position, at least one receptacle fixedly connected to the upper portion of said clamping assembly for holding various articles at a point above the horizontal plane of the table, slot means disposed in the upper portion of the clamping assembly for holding relatively small articles at a point above the horizontal plane of the table, and at least one hook member depending from the lower portion of said clamping assembly for holding towels or the like at a point below the horizontal plane of the table.

Accordingly, it is the object of the present invention to provide a simply structured yet sturdy article attachment device which can be removably mounted to the horizontal side edge of a table, bar or the like.

It is another object of the present invention to provide an article attachment device having receptacles and other means for holding articles at locations which are easily accessible to all gathered about a bar or table, that is, above the horizontal plane thereof and perhaps extending over the horizontal surface thereof.

It is another object of the present invention to provide an article attachment device which has hook means located at a point below the horizontal plane of the table or bar and perhaps directly beneath the horizontal surface thereof so that handbags or the like are hidden from guests gathered about the table or bar yet are easily accessible to the host or other person who may need the same to clean the horizontal surface of the table or bar.

It is yet another object of the present invention to provide an article attachment device which does not require the use of tools or excessive manual strength in order to removably mount the same into assembled position.

These and other objects will become apparent, as will a better understanding of the concepts underlying the present invention, by reference to the detailed description which follows taken with the drawings in which:

DETAILED DESCRIPTION OF THE INVENTION

Figure 1:
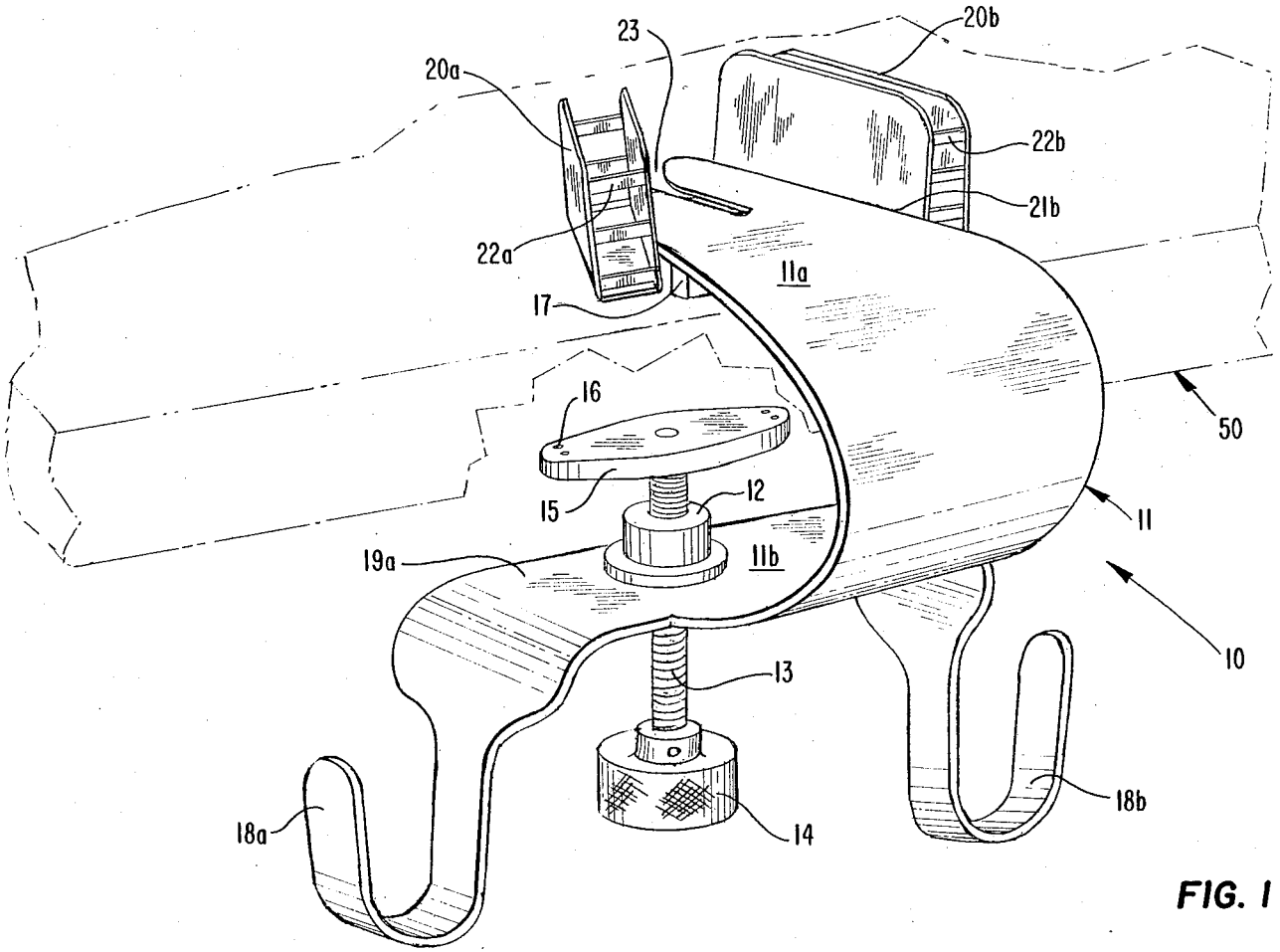
FIG. 1 is a perspective view showing the preferred embodiment of the article attachment in accordance with the present invention clamped to the side edge of a horizontal platform.

Referring to the drawings, FIGS. 1–6 illustrate one embodiment of the removably mountable article attachment assembly generally designated as 10 in accordance with the present invention.

FIGS. 1–4 inclusive show the article attachment device 10 in assembled position on the side edge of the horizontal member 50 which represents a bar, table or the like.

Figure 5:
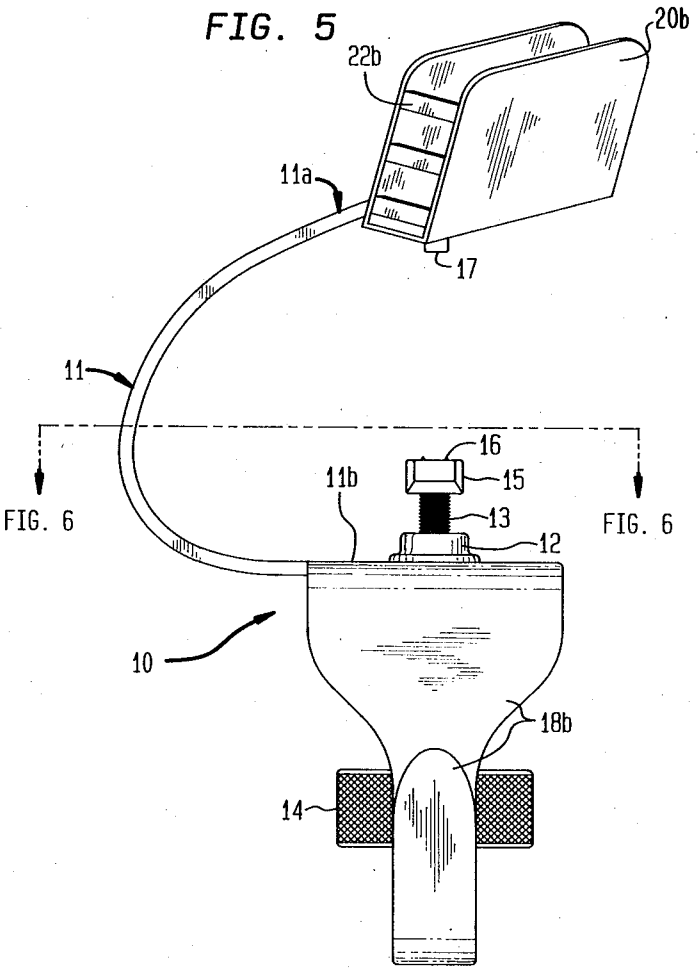
FIG. 5 is a right side view of the preferred embodiment of the article attachment in accordance with the present invention.
Figure 4:
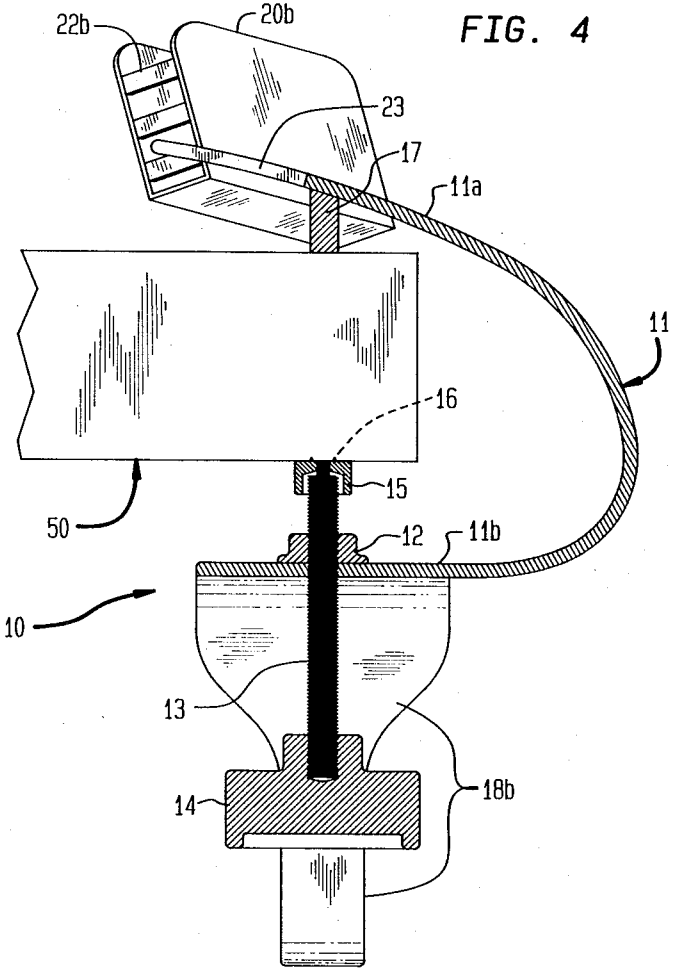
FIG. 4 is a vertical cross-section taken on line 4—4 of the article attachment shown in FIG. 2.
Figure 6:
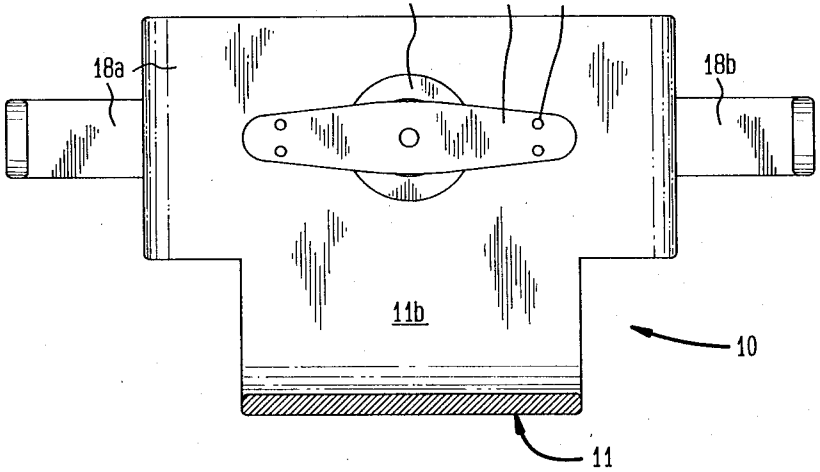
FIG. 6 is a horizontal cross-section taken on line 6—6 of the article attachment shown in FIG. 5.

The clamping assembly of the article attachment device 10 provides a generally C-shaped member 11 which has an upper section **11*a* and a lower section 11*b*, as is clearly shown in FIGS. 4–6, inclusive. Generally C-shaped member 11 is made from any suitably strong metal or plastic, the preferred embodiment shown herein being made of aluminum which is easily bent into the C-shape shown so that the article attachment device 10 can be mounted around the side edge of horizontal member 50, as shown in FIGS. 1 and 4**.

It is particularly noted that the circumference, or the greatest distance between upper section **11*a* and lower section 11*b***, can be varied to accommodate side edges having different widths or shapes. This concept will be better understood after a description of the clamping mechanism which follows immediately below.

The clamping assembly further comprises a clamping mechanism which is operatively associated with C-shaped member 11 and provides a threaded bushing 12 fixedly inserted through a hole located in the central region of lower section 11*b*. A clamping screw 13 having male threads which matingly engage the female threads of bushing 12 is disposed for vertical movement upon the turning of knurled knob 14 which is fixedly connected to the end of clamping screw 13 below lower section 11*b*, as is clearly shown in FIGS. 1, 2 and 4. At the end remote therefrom, in the region between upper section 11*a* and lower section 11*b*, movable clamping head 15 is rotatably mounted in horizontal elevation to clamping screw 13 for vertical movement therewith and engagement with the lower surface of horizontal member 50, as FIG. 4 illustrates.

FIGS. 5–7 show gripping prongs 16 which are provided in spaced relation to one another on the upper surface of movable clamping head 15 for engaging and gripping the lower surface of horizontal member 50 in the manner shown in FIG. 4. The purpose of rotatably mounting movable clamping head 15 to clamping screw 13 and the provision of gripping prongs 16 will become apparent from a description of the procedure for mounting the article attachment assembly 10 to horizontal member 50, as set forth below.

Stationary clamping head 17 is fixedly connected to the lower surface of upper section 11*a*, by means of welding or the like, directly above movable clamping head 15 for operative association therewith by engaging the upper surface of horizontal member 50. It should be noted that there are no gripping prongs provided on stationary clamping head 17 so that the upper finished surface of horizontal member 50 will not become marred or defaced by mounting the article attachment assembly 10 thereto.

The two hook members 18*a* and 18*b* which are shown in the FIGURES depend downwardly from either side of lower section 11*b* and are preferably formed from the same material as the generally C-shaped member 11. One skilled in the art will recognize that it is possible to integrally form hook members 18*a* and 18*b* with generally C-shaped member 11, however, if manufacturing facilities are limited, hook members 18*a* and 18*b* can be welded or otherwise fixed to either side of lower section 11*b* as at 19*a* and 19*b* which is clearly shown in FIG. 6.

Figure 3:
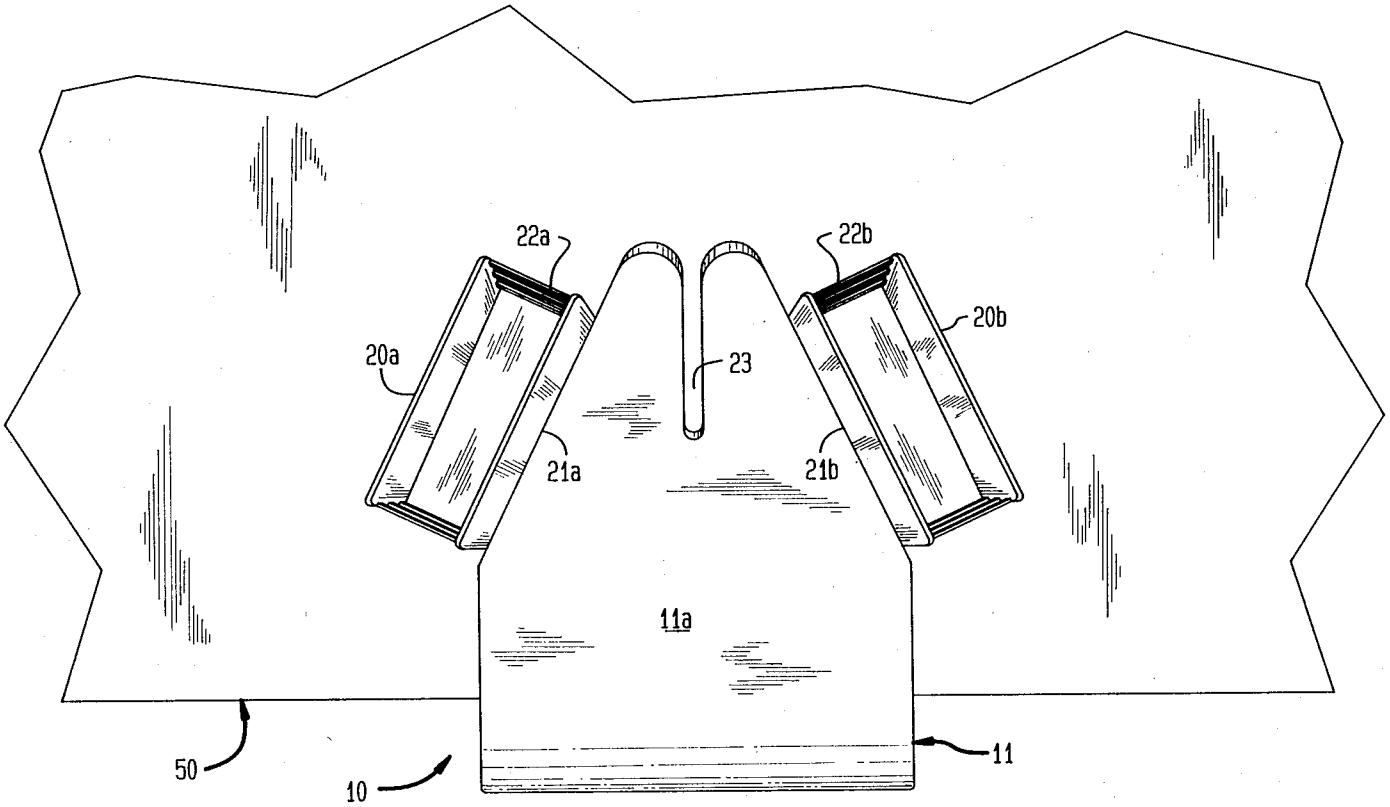
FIG. 3 is a top plan view of the article attachment shown in FIG. 1.

It is particularly important to note that in the preferred embodiment hook members 18*a* and 18*b* are formed and fixed to lower section 11*b* so that the same are located not only below the horizontal plane of horizontal member 50 but directly beneath the lower surface of horizontal member 50. FIG. 3 clearly shows that hook members 18*a* and 18*b* are not visable from a top plan view of the article attachment device 10 when the same is mounted to the side edge of horizontal member 50. The concept of situating hook members 18*a* and 18*b* below the horizontal plane of horizontal member 50 and directly beneath the lower surface thereof serves to hide any handbags, towels or rags hung thereon from guests or others gathered about the table or bar, yet enables easy access to said towels or rags for the host or other person in close proximity to article attachment device 10 so that such a person can maintain a clean bar or table without leaving the immediate area.

FIG. 3 shows that upper section 11*a* is tapered inwardly at a point beyond the affixation of stationary clamping head 17. Two receptacles 20*a* and 20*b* are fixedly connected, by welding or other suitable means, to the tapered side edges 21*a* and 21*b*, respectively, of upper section 11*a*. In the preferred embodiment, receptacles 20*a* and 20*b* are formed from aluminum as is generally C-shaped member 11, and consists of the same being twice bent at right angles to define areas in which a pack of cigarettes, a deck of cards, or the like can be held.

The preferred embodiment further shows struts 22*a* and 22*b* which are disposed less for strength and more for preventing articles from falling from said receptacles 20*a* and 20*b*.

Figure 2:
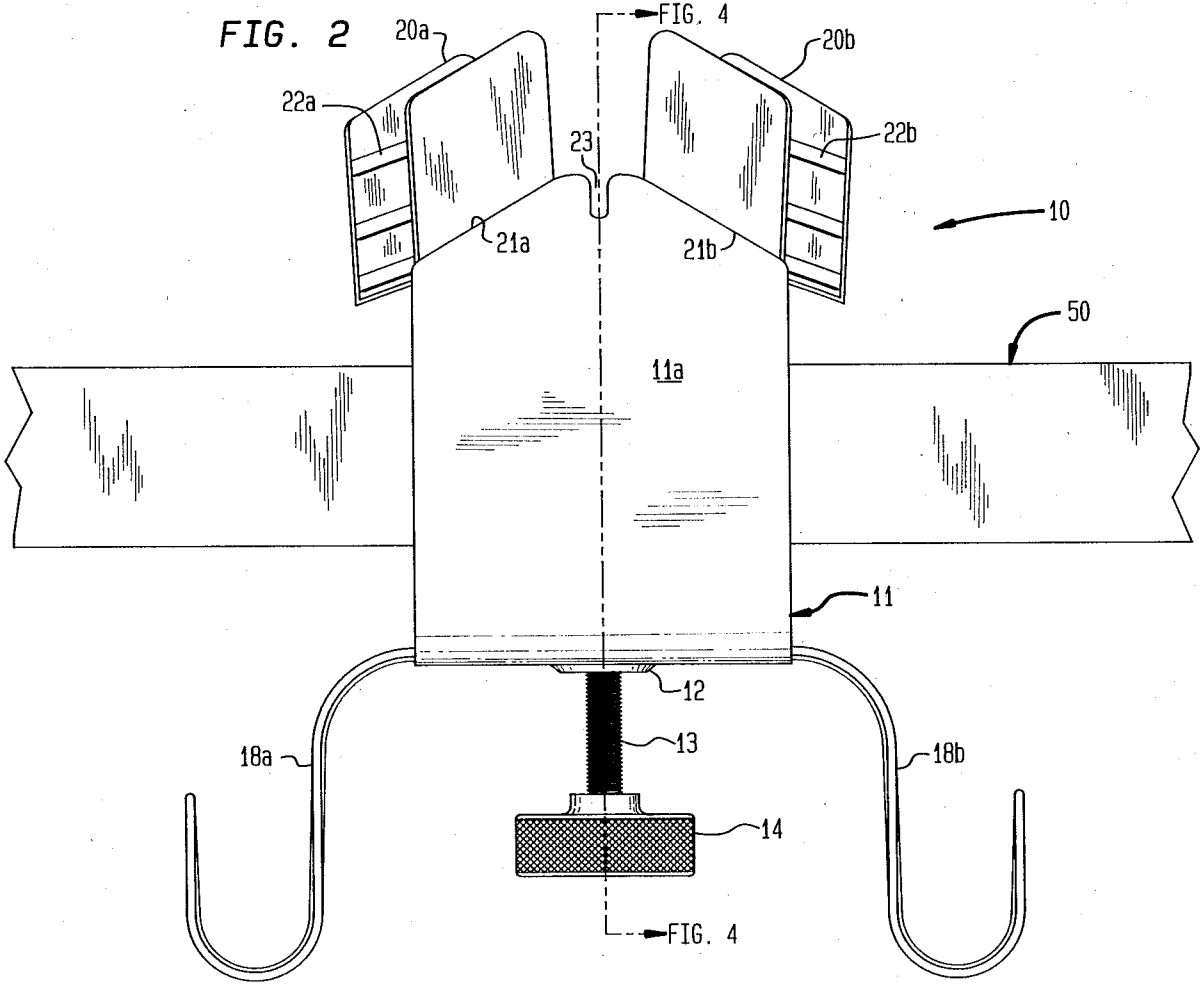
FIG. 2 is a front view of the article attachment shown in FIG. 1.

The preferred embodiment further provides a slot 23 which is cut from upper section 11*a* and disposed between receptacle 20*a* and receptacle 20*b*, as is clearly shown in FIGS. 1–3, inclusive. Slot 23 is sized to accommodate a book of matches, a pad of paper or the like.

It is particularly recognizable that slot 23 and receptacles 20*a* and 20*b* are disposed on upper section 11*a* of C-shaped member 11 so that when article attachment assembly 10 is mounted to horizontal member 50, receptacles 20*a* and 20*b* and slot 23 are located above the horizontal plane of horizontal member 50 and directly above the upper surface thereof. This configuration enables any person gathered about the table or bar to have access to the articles held in receptacles 20*a* and 20*b* and slot 23 without the help of the host, bartender or other person who is in close proximity to attachment assembly 10. Further in this regard, the FIGURES show that receptacles 20*a* and 20*b* provide even easier access to the articles contained therein in that said receptacles are angled outwardly towards the extremities of the bar or table, that is, towards the guests gathered thereabout.

Article attachment device 10 is easily mounted to the side edge of horizontal member 50 by merely situating the generally C-shaped member 11 around said side edge so that stationary clamping head 17 is in contact with the upper surface of horizontal member 50 and moveable clamping head 15 is in contact with the lower surface of horizontal member 50. As knurled knob 14 is turned in the clockwise direction, gripping prongs 16 will engage the lower surface of horizontal member 50 and "bite" into the wood or other material, thus preventing movable clamping head 15 from turning with clamping screw 13 upon which the moveable clamping head is rotatably mounted. Knurled knob 14 is preferably enlarged to facilitate in the manual turning thereof, said turning to continue until article attachment device 10 is rigidly secured to horizontal member 50 by virtue of the compressive clamping action between the operatively associated clamping heads 15 and 17.

Thus, a simply structured and inexpensive article attachment device which can be removably mounted to a horizontal platform and cures the many deficiencies inherent in the structure and operation of the prior art devices, has been described.

While the foregoing description and accompanying FIGURES illustrate one preferred embodiment of the article attachment device 10 in accordance with the present invention, it will be appreciated that certain modifications may be made to the structure of the disclosed embodiment without departing from the spirit and scope of the invention as defined by the claims which are set forth immediately below.

What is claimed is:

1. An article attachment assembly particularly adapted for association with the horizontal plane of bars, tables, and the like comprising, a. a generally C-shaped member having an upper section and a lower section;

b. a clamping assembly connected to said C-shaped member for securing the same to a side edge of the bar, table, or the like;

c. at least one receptacle connected to said upper section of said C-shaped member for holding cigarettes, cards or similar articles at a point above the horizontal plane of the bar, table or the like;

d. said upper section having slot means for holding a book of matches, pad of paper or similar articles at a point above the horizontal plane of the bar, table or the like; and e. at least one hook member depending outwardly from said lower section of said C-shaped member for holding handbags, towels or the like at a point below the horizontal plane of the bar, table or the like.

2. An article attachment assembly as claimed in claim 1, wherein the said at least one receptacle is located directly above the horizontal surface of the table or bar to increase the degree of accessibility thereto.

3. An article attachment assembly as claimed in claim 2, wherein the said at least one receptacle is angled outwardly toward the extremities of the table or bar to further increase the degree of accessibility thereto.

4. An article attachment assembly as claimed in claim 2, wherein the said at least one receptacle is connected to said upper section in oblique relation to the side edge of the table or bar to increase the degree of accessibility thereto.

5. An article attachment assembly as claimed in claim 1, wherein two receptacles are connected on either side of said upper section, and said slot means is disposed therebetween.

6. An article attachment assembly as claimed in claim 1, wherein two hook members depend outwardly from either side of said lower section and are located directly beneath the table or bar.

7. An article attachment assembly as claimed in claim 6, wherein the two hook members are disposed in spaced relation to the table or bar to prevent the table or bar from obstructing access to the towels or the like hung on said hook members.

8. An article attachment assembly as claimed in claim 1, wherein the means for removably mounting the same to a table includes, a. a threaded bushing fixed in the central region of the lower section;

b. a screw member extending through said threaded bushing disposed for vertical movement with relation to the upper section of the C-shaped member;

c. a moveable clamping head rotatably mounted on said screw member between the upper section and the lower section of the C-shaped member;

d. a knurled knob fixed to the end of the screw member remote from the moveable clamping head to facilitate in moving the same in the vertical direction; and e. a stationary clamping head fixedly connected to the upper section for operatively engaging said table or bar in association with said moveable clamping head.

9. An article attachment assembly as claimed in claim 8, wherein at least one prong is provided on the moveable clamping head to prevent the same from rotating upon the turning of the knurled knob.

10. An article attachment assembly as claimed in claim 8, wherein said knurled knob is enlarged to facilitate in manually turning the same.

* * * * *